US011587481B2

(12) United States Patent
Kwon et al.

(10) Patent No.: US 11,587,481 B2
(45) Date of Patent: Feb. 21, 2023

(54) DISPLAY DEVICE AND METHOD OF DRIVING THE SAME

(71) Applicant: LG Display Co., Ltd., Seoul (KR)

(72) Inventors: SangGoo Kwon, Gwangmyeong-si (KR); MooKyoung Hong, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/561,390

(22) Filed: Dec. 23, 2021

(65) Prior Publication Data

US 2022/0208045 A1 Jun. 30, 2022

(30) Foreign Application Priority Data

Dec. 31, 2020 (KR) ..... 10-2020-0189398

(51) Int. Cl.
*G09G 3/3233* (2016.01)
*G09G 3/00* (2006.01)
*G09G 3/20* (2006.01)

(52) U.S. Cl.
CPC ..... *G09G 3/006* (2013.01); *G09G 3/20* (2013.01); *G09G 2310/0275* (2013.01); *G09G 2330/12* (2013.01)

(58) Field of Classification Search
CPC .. G09G 3/006; G09G 3/20; G09G 2310/0275; G09G 2330/12; G09G 2330/10; G09G 2310/027; G09G 2370/14; G09G 3/3258; G09G 3/3266; G09G 3/3275
See application file for complete search history.

(56) References Cited

U.S. PATENT DOCUMENTS 11,348,519 B2 * 5/2022 Nam ..... G09G 3/2025
2011/0130981 A1 * 6/2011 Chaji ..... G01R 31/44 702/58
2013/0235023 A1 * 9/2013 Chaji ..... G09G 3/3233 345/212
2013/0257845 A1 * 10/2013 Chaji ..... G09G 3/3258 345/212
2014/0176525 A1 * 6/2014 Woo ..... G09G 3/3233 345/212
2014/0329339 A1 * 11/2014 Chaji ..... G09G 3/006 438/10
2016/0027382 A1 * 1/2016 Chaji ..... G09G 3/006 345/212
2016/0125811 A1 * 5/2016 Park ..... G09G 3/3258 345/694

(Continued)

FOREIGN PATENT DOCUMENTS

KR 10-2016-0050832 A 5/2016
KR 10-2020-0077812 A 7/2020

*Primary Examiner* — Jose R Soto Lopez
(74) *Attorney, Agent, or Firm* — Birch, Stewart, Kolasch & Birch, LLP

(57) ABSTRACT

A display device can include a display panel having a plurality of sub pixels, each of the sub pixels including a switching transistor, a driving transistor, a sensing transistor, a storage capacitor, and a light emitting element; and a detector configured to sense a voltage difference between a first electrode of the sensing transistor and a second electrode of the sensing transistor for determining that an anode and a cathode of the light emitting element are shorted, in which a gate electrode of the switching transistor and a gate electrode of the sensing transistor are connected to a same gate line.

19 Claims, 6 Drawing Sheets

(56) References Cited

U.S. PATENT DOCUMENTS

| | | | | |
|---|---|---|---|---|
| 2018/0033373 | A1* | 2/2018 | Hong | G09G 3/325 |
| 2018/0053462 | A1* | 2/2018 | Bae | G09G 3/2074 |
| 2018/0061296 | A1* | 3/2018 | Shim | G09G 3/3258 |
| 2018/0114815 | A1* | 4/2018 | Lee | H01L 51/0031 |
| 2019/0108777 | A1* | 4/2019 | Yuan | G09G 3/3233 |
| 2019/0259325 | A1* | 8/2019 | Chaji | G06T 7/90 |
| 2020/0335035 | A1* | 10/2020 | Gai | G09G 3/3233 |
| 2021/0201780 | A1* | 7/2021 | Xu | G09G 3/006 |
| 2022/0157233 | A1* | 5/2022 | Zheng | G09G 3/3208 |

* cited by examiner

DISPLAY DEVICE AND METHOD OF DRIVING THE SAME

CROSS-REFERENCE TO RELATED APPLICATIONS

This application claims priority to Korean Patent Application No. 10-2020-0189398 filed on Dec. 31, 2020, in the Republic of Korea, the entire contents of which are hereby expressly incorporated by reference into the present application.

BACKGROUND

Field

The present disclosure relates to a display device, and more particularly, to a display device which is capable of detecting whether a short (e.g., short circuit) occurs between an anode and a cathode of a light emitting element.

Description of the Related Art

As for display devices which are used for a monitor of a computer, a television, or a cellular phone, there are an organic light emitting display device (OLED) which is a self-emitting device (e.g., no backlight needed), a liquid crystal display device (LCD) which requires a separate light source, and the like.

Among various display devices, an organic light emitting display device includes a display panel including a plurality of sub pixels and a driver which drives the display panel. In each of the sub pixels of the display panel, a light emitting element is disposed. The driver includes a gate driver which supplies a gate signal to the display panel and a data driver which supplies a data voltage. When a signal, such as a gate signal and a data voltage, is supplied to a sub pixel of the organic light emitting display device, a light emitting element of the selected sub pixel emits light to display images. However, in the light emitting element, a defect that an anode and a cathode are shorted (e.g., short circuited) during the manufacturing process or after completing the manufacturing process may occur. In this situation, a display panel may quickly develop a dead sub pixel that is highly noticeable by a viewer.

SUMMARY OF THE DISCLOSURE

An object to be achieved by the present disclosure is to detect a defective sub pixel in which the short occurs in a light emitting element by sensing a voltage difference between a first electrode and a second electrode of a sensing transistor.

Another object to be achieved by the present disclosure is to delay the darkening of the light emitting element in which the short occurs, by reducing an output of a defective sub pixel.

Objects of the present disclosure are not limited to the above-mentioned objects, and other objects, which are not mentioned above, can be clearly understood by those skilled in the art from the following descriptions.

In order to achieve the above-described objects, according to an aspect of the present disclosure, a display device includes a display panel having a plurality of sub pixels including a switching transistor, a driving transistor, a sensing transistor, a storage capacitor, and a light emitting element, and a detection unit configured to sense a voltage difference between a first electrode and a second electrode of the sensing transistor to detect whether an anode and a cathode of the light emitting element are shorted. A gate electrode of the switching transistor and a gate electrode of the sensing transistor are connected to the same gate line.

According to another aspect of the present disclosure, a driving method of a display device includes turning on a sensing transistor of each of the plurality of sub pixels, and applying a first reference voltage to a first electrode of the sensing transistor through a first initialization switch, turning off the sensing transistor, and applying a second reference voltage to a second electrode of the sensing transistor through a second initialization switch, turning on the sensing transistor, and transmitting a voltage difference between the first electrode and the second electrode of the sensing transistor to the detection unit through a sampling switch, and detecting whether an anode and a cathode of the light emitting element in the plurality of sub pixels are shorted by comparing the voltage difference of the plurality of sub pixels, through the detection unit.

Other detailed matters of the example embodiments are included in the detailed description and the drawings.

According to the present disclosure, different voltages are applied to a first electrode and a second electrode of a sensing transistor during different time intervals by a driving initialization switch and a sensing initialization switch to detect whether a light emitting element is shorted.

According to the present disclosure, a compensation process is performed in a sub pixel in which a short occurs, in order to extend a lifespan of the display device.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
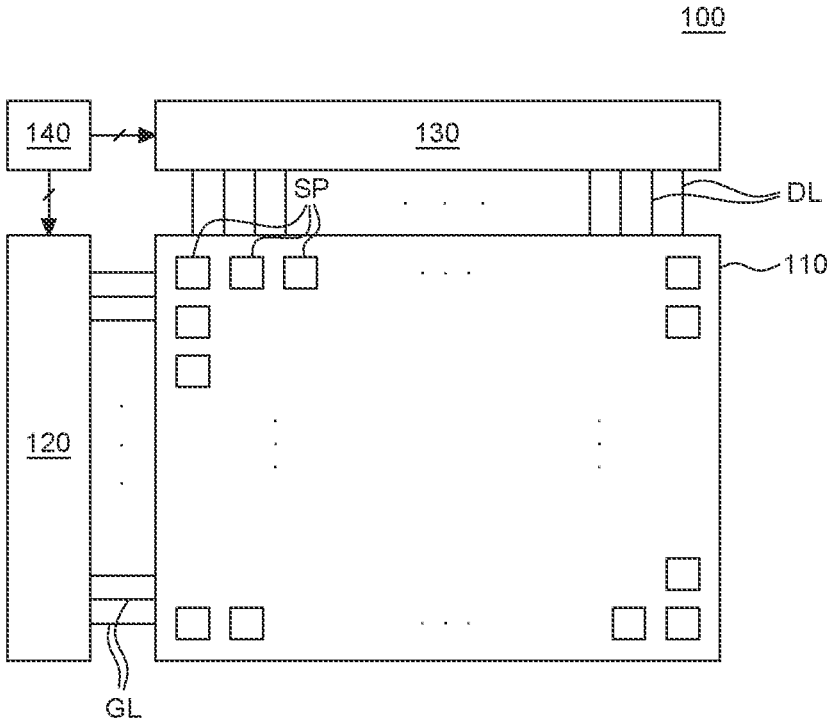
FIG. 1 is a schematic view of a display device according to an example embodiment of the present disclosure.

Advantages and characteristics of the present disclosure and a method of achieving the advantages and characteristics will be clear by referring to example embodiments described below in detail together with the accompanying drawings. However, the present disclosure is not limited to the example embodiments disclosed herein but will be implemented in various forms. The example embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the example embodiments of the present disclosure are merely examples, and the present disclosure is not limited thereto. Like reference numerals generally denote like elements throughout the specification. Further, in the following description of the present disclosure, a detailed explanation of known related technologies can be omitted to avoid unnecessarily obscuring the subject matter of the present disclosure. The terms such as "including," "having," and "consist of" used herein are generally intended to allow other components to be added unless the terms are used with the term "only." Any references to singular can include plural unless expressly stated otherwise.

Components are interpreted to include an ordinary error range even if not expressly stated.

When the position relation between two parts is described using the terms such as "on," "above," "over," "below," and "next," one or more parts can be positioned between the two parts unless the terms are used with the term "immediately" or "directly."

When an element or layer is disposed "on" another element or layer, another layer or another element can be interposed directly on the other element or therebetween.

Although the terms "first," "second," and the like are used for describing various components, these components are not confined by these terms. These terms are merely used for distinguishing one component from the other components. Therefore, a first component to be mentioned below can be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, the present disclosure will be described in detail with reference to accompanying drawings.

FIG. 1 is a schematic view of a display device according to an example embodiment of the present disclosure. All the components of each display device according to all embodiments of the present disclosure are operatively coupled and configured.

Referring to FIG. 1, a display device 100 includes a display panel 110, a gate driver 120, a data driver 130, and a timing controller 140.

The display panel 110 is a panel for displaying images. The display panel 110 can include various circuits, wiring lines, and light emitting elements disposed on the substrate. The display panel 110 includes a display area defined by a plurality of sub pixels SP and a non-display area in which various signal lines, pads, or the like are formed. The display panel 110 can be implemented by a display panel 110 used in various display devices such as a liquid crystal display device, an organic light emitting display device, an electrophoretic display device, or the like. Hereinafter, the display panel 110 is described as a panel used in the organic light emitting display device, but is not limited thereto.

The plurality of sub pixels SP is divided by a plurality of gate lines GL and a plurality of data lines DL intersecting each other and can be connected to the plurality of gate lines GL and the plurality of data lines DL. The plurality of sub pixels SP can be sub pixels SP for emitting different color light. For example, the plurality of sub pixels SP can include a red sub pixel, a green sub pixel, a blue sub pixel, and a white sub pixel, but is not limited thereto.

The timing controller 140 receives timing signals, such as a vertical synchronization signal, a horizontal synchronization signal, a data enable signal, or a dot clock, by means of a receiving circuit, such as an LVDS or TMDS interface, connected to a host system. The timing controller 140 generates timing control signals based on the input timing signal to control the gate driver 120 and the data driver 130.

The gate driver 120 supplies a gate signal to the plurality of sub pixels SP. The gate driver 120 can include a level shifter and a shift register. The level shifter shifts a level of a clock signal CLK input at a transistor-transistor-logic (TTL) level from the timing controller 140 and then supplies the clock signal CLK to the shift register. The shift register can be formed in the non-display area of the display panel 110, by a GIP manner, but is not limited thereto. The shift register is configured by a plurality of stages which shifts and outputs the gate signal, in response to the clock signal CLK and the driving signal. The plurality of stages included in the shift register sequentially outputs the gate signal through a plurality of output ends.

The data driver 130 supplies a data voltage Vdata to the plurality of sub pixels SP. The data driver 130 includes a plurality of source drive ICs (integrated circuits). The plurality of source drive ICs can be supplied with digital video data RGB and a source timing control signal DDC from the timing controller 140. The plurality of source drive ICs converts digital video data RGB into a gamma voltage in response to the source timing control signal DDC to generate a data voltage Vdata and supply the data voltage Vdata through the data line DL of the display panel 110. The plurality of source drive ICs can be connected to the data line DL of the display panel 110 by a chip on glass (COG) process or a tape automated bonding (TAB) process. Further, the source drive ICs are formed on the display panel 110 or are formed on a separate printed circuit board (PCB) substrate to be connected to the display panel 110.

Hereinafter, a driving circuit for driving one sub pixel SP will be described in more detail with reference to FIG. 2 together.

Figure 2:
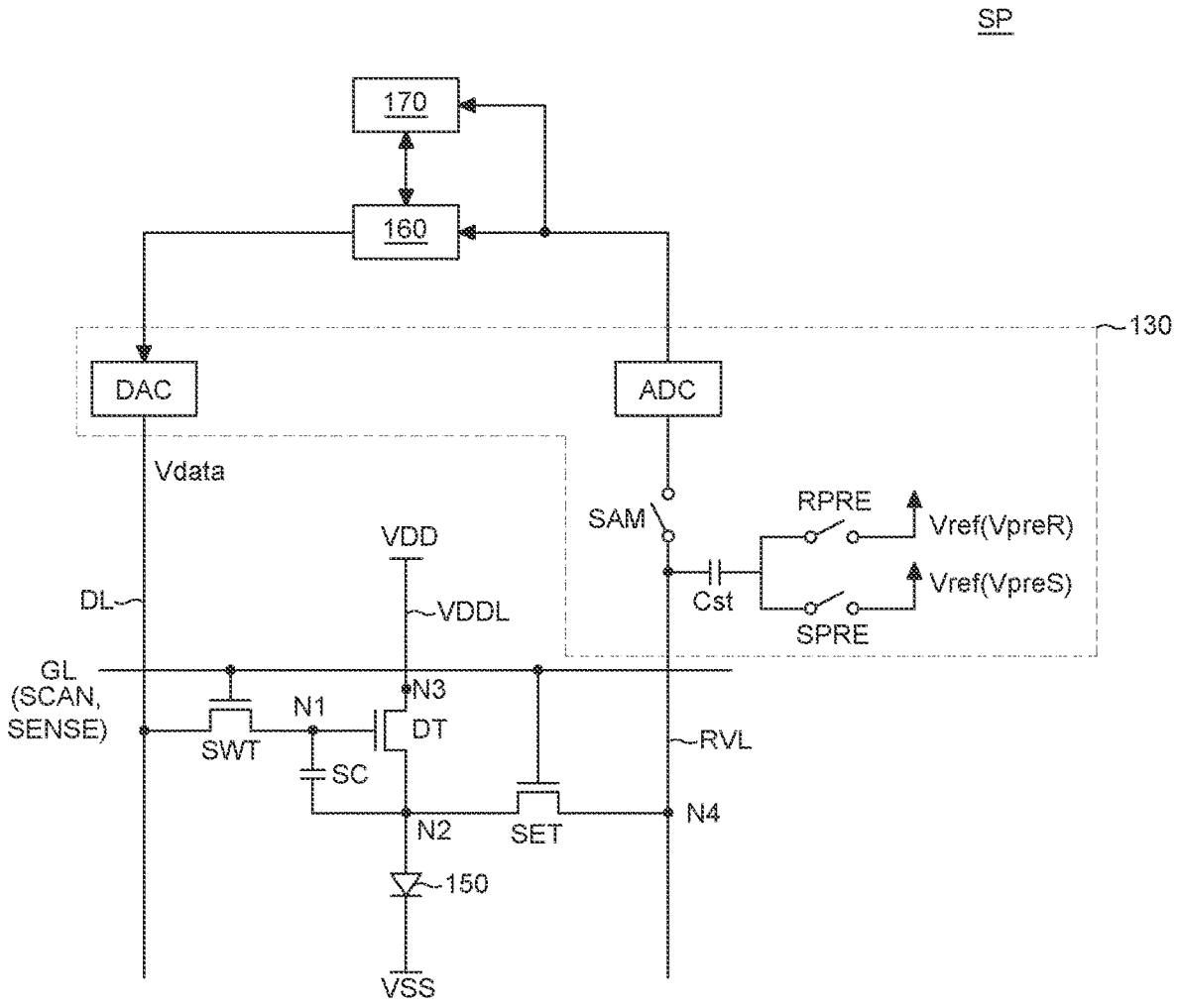
FIG. 2 is a circuit diagram of a sub pixel of a display device according to an example embodiment of the present disclosure.

FIG. 2 is a circuit diagram of a sub pixel of a display device according to an example embodiment of the present disclosure. In FIG. 2, a circuit diagram for one sub pixel SP among the plurality of sub pixels SP of the display device 100 is illustrated.

Referring to FIG. 2, the sub pixel SP can include a switching transistor SWT, a sensing transistor SET, a driving transistor DT, a storage capacitor SC, and a light emitting element 150.

The light emitting element 150 can include an anode, an organic layer, and a cathode. The organic layer can include various organic layers, such as a hole injection layer, a hole transport layer, an organic light emitting layer, an electron transport layer, and an electron injection layer. The anode of the light emitting element 150 can be connected to an output terminal of the driving transistor DT and a low potential voltage VSS is applied to the cathode. Even though in FIG. 2, the light emitting element 150 is described as an organic light emitting element 150, the present disclosure is not limited thereto so that as the light emitting element 150, an inorganic light emitting element, for example, an LED can also be used.

The switching transistor SWT is a transistor which transmits the data voltage Vdata to a first node N1 corresponding to a gate electrode of the driving transistor DT. The switching transistor SWT can include a drain electrode connected to the data line DL, a gate electrode connected to the gate line GL, and a source electrode connected to the gate electrode of the driving transistor DT. The switching transistor SWT is turned on by a scan signal SCAN applied from the gate line GL to transmit the data voltage Vdata supplied from the data line DL to the gate electrode of the driving transistor DT.

The driving transistor DT is a transistor which supplies a driving current to the light emitting element 150 to drive the light emitting element 150. The driving transistor DT can include a gate electrode corresponding to the first node N1, a source electrode corresponding to a second node N2 and an output terminal, and a drain electrode corresponding to a third node N3 and an input terminal. The gate electrode of the driving transistor DT is connected to the switching transistor SWT, the drain electrode is applied with a high potential voltage VDD by means of a high potential voltage line VDDL, and the source electrode is connected to the anode of the light emitting element 150.

A storage capacitor SC is a capacitor which maintains a voltage corresponding to the data voltage Vdata for one frame. One electrode of the storage capacitor SC can be connected to the first node N1 and the other electrode can be connected to the second node N2.

In addition, in the situation of the display device 100, as the driving time of each sub pixel SP is increased, the circuit element, such as the driving transistor DT, may become degraded. Accordingly, a unique characteristic value of the circuit element in the sub pixel SP may change. Here, the unique characteristic value of the circuit element can include a threshold voltage Vth of the driving transistor DT, a mobility a of the driving transistor DT, or the like. The change in the characteristic value of the circuit element can cause a luminance change of the corresponding sub pixel SP. Accordingly, the change in the characteristic value of the circuit element can be used as the same concept as the luminance change of the sub pixel SP.

Further, the degree of the change in the characteristic values between circuit elements of each sub pixel SP can vary depending on a degree of degradation of each circuit element. Such a difference in the changing degree of the characteristic values between the circuit elements can cause a luminance deviation between the sub pixels SP. Accordingly, the characteristic value deviation between circuit elements can be used as the same concept as the luminance deviation between the sub pixels SP. The change in the characteristic values of the circuit elements, for example, the luminance change of the sub pixel SP and the characteristic value deviation between the circuit elements, for example, the luminance deviation between the sub pixels SP can cause problems, such as the lowering of the accuracy for luminance expressiveness of the sub pixel SP, an erroneous screen, or the like.

Therefore, the sub pixel SP of the display device 100 according to an example embodiment of the present disclosure can provide a sensing function of sensing a characteristic value for the sub pixel SP and a compensating function of compensating for the characteristic value of the sub pixel SP using the sensing result. For example, the display device 100 can sense a voltage charged in a line or an electrode, a current flowing through a node, charges accumulated in the capacitor, and the like and compensate for the degradation of the element included in the sub pixel SP based thereon.

Therefore, as illustrated in FIG. 2, the sub pixel SP can further include a sensing transistor SET to effectively control a voltage state of the source electrode of the driving transistor DT, in addition to the switching transistor SWT, the driving transistor DT, the storage capacitor SC, and the light emitting element 150.

The sensing transistor SET is a transistor which is added to sense the degradation of the driving transistor DT or the light emitting element 150 or a threshold voltage. The sensing transistor SET can be utilized as a voltage sensing path for the second node N2 between the driving transistor DT and the light emitting element 150. For example, the sensing transistor SET can acquire a sensing value by means of the second node N2 and transmit the sensing value to an external compensation circuit through a reference voltage line RVL.

The sensing transistor SET is connected between the source electrode of the driving transistor DT and the reference voltage line RVL which supplies a reference voltage Vref. For example, the sensing transistor SET can be connected to the second node N2 and the fourth node N4. At this time, a portion of the sensing transistor SET corresponding to the second node N2 can be defined as an input terminal or a first electrode and a portion of the sensing transistor SET corresponding to the fourth node N4 can be defined as an output terminal or a second electrode. Further, the gate electrode of the sensing transistor SET is connected to the gate line GL. Therefore, the sensing transistor SET is turned on by the sensing signal SENSE applied through the gate line GL to apply the reference voltage Vref which is supplied through the reference voltage line RVL to the source electrode of the driving transistor DT.

In addition, the reference voltage line RVL not only serves to transmit the reference voltage Vref, but also serves as a sensing line for sensing a characteristic value of a circuit element in the sub pixel SP (e.g., the sensing line can be used to provide dual functions of supplying the reference voltage Vref and sensing a characteristic value of a circuit element). Therefore, the reference voltage line RVL can also be defined as a sensing line.

The switching transistor SWT and the sensing transistor SET of the sub pixel SP can share one gate line GL. For example, the switching transistor SWT and the sensing transistor SET are connected to the same gate line GL to be applied with the same gate signal. However, for the convenience of description, a gate signal which is applied to the gate electrode of the switching transistor SWT is referred to as a scan signal SCAN and a gate signal which is applied to the gate electrode of the sensing transistor SET is referred to as a sensing signal SENSE. However, the scan signal SCAN and the sensing signal SENSE applied to one sub pixel SP are the same signal which is transmitted from the same gate line GL.

In addition, the display device 100 can further include an analog-digital converter ADC, a compensation unit 160 (e.g., compensation part or compensation circuit portion), a detection unit 170 (e.g., a detector, detection part or detection circuit portion), a digital-analog converter DAC, a driving initialization switch RPRE, a sensing initialization switch SPRE, a sampling switch SAM, and a capacitor Cst. A characteristic value for the sub pixel SP is sensed thereby and the characteristic value of the sub pixel SP can be compensated in accordance with a sensing result. Specifically, the display device 100 can detect whether the light emitting element 150 included in the sub pixel SP is shorted (e.g., short circuited), by the detection unit 170.

In addition, the analog-digital converter ADC, the digital-analog converter DAC, the driving initialization switch RPRE, the sensing initialization switch SPRE, the sampling switch SAM, and the capacitor Cst can be included in the data driver 130, but are not limited thereto. Further, the compensation unit 160 and the detection unit 170 can be included in the timing controller 140, but are not limited thereto. Further, in FIG. 2, a memory which stores sensing data and stores a compensation value calculated by a compensation processing result can be further included.

The driving initialization switch RPRE controls whether to apply a reference voltage Vref to the reference voltage line RVL. At this time, the driving initialization switch RPRE is a switch which controls image driving. When the driving initialization switch RPRE is turned on, the driving initialization switch RPRE is connected to the reference voltage line RVL to apply the reference voltage Vref to the sensing transistor SET. At this time, the reference voltage Vref which is applied by the driving initialization switch RPRE can be a driving reference voltage VpreR for image driving. The driving reference voltage VpreR can be applied to make the element be in a state or environment suitable to be compensated, recovered, or driven, by means of the reference voltage line RVL. Also, the driving initialization switch RPRE is referred to as a first initialization switch and the driving reference voltage VpreR is referred to as a first reference voltage.

The sensing initialization switch SPRE controls whether to apply the reference voltage Vref to the reference voltage line RVL. At this time, the sensing initialization switch SPRE is a switch which controls the sensing. When the sensing initialization switch SPRE is turned on, the sensing initialization switch SPRE is connected to the reference voltage line RVL to apply the reference voltage Vref to the sensing transistor SET. At this time, the reference voltage Vref, which is applied by the sensing initialization switch SPRE, can be a sensing reference voltage VpreS for sensing. Further, the sensing reference voltage VpreS and the driving reference voltage VpreR can have different values. The sensing reference voltage VpreS is applied to make the reference voltage line RVL be in a state or environment suitable for the sensing. Also, the sensing initialization switch SPRE is referred to as a second initialization switch and the sensing reference voltage VpreS is referred to as a second reference voltage.

The capacitor Cst is connected between the reference voltage line RVL and the initialization switches RPRE and SPRE. For example, one electrode of the capacitor Cst can be connected to the reference voltage line RVL. Further, the other electrode can be connected to a point which is shared by an output end of the driving initialization switch RPRE and an output end of the sensing initialization switch SPRE. The capacitor Cst can store a voltage sensed by the sensing transistor SET, before turning on the sampling switch SAM.

The sampling switch SAM controls whether to connect the reference voltage line RVL and the analog-digital converter ADC. The sampling switch SAM is turned on to connect the reference voltage line RVL and the analog-digital converter ADC. An on-off timing of the sampling switch SAM can be controlled to be turned on when the source electrode of the driving transistor DT is in a voltage state which reflects a desired characteristic value of the circuit element to transmit a voltage from the sensing transistor SET to the compensation unit 160. When the sampling switch SAM is turned on, the analog-digital converter ADC can sense a voltage of the connected reference voltage line RVL.

The analog-digital converter ADC generates sensing data by sensing the voltage of the reference voltage line RVL and outputs the sensing data to the compensation unit 160 or the detection unit 170. Specifically, the analog-digital converter ADC converts the sensed analog sensing value into a digital sensing value to output the converted digital sensing value. At this time, the voltage sensed by the analog-digital converter ADC can be a voltage for sensing a threshold voltage Vth of the driving transistor DT, a mobility a of the driving transistor DT, or whether the light emitting element 150 is shorted, but is not limited thereto.

The compensation unit 160 identifies the characteristic value for the circuit element using the sensing data output from the analog-digital converter ADC and performs a compensation process which compensates for the characteristic value for the circuit element. For example, the compensation unit 160 can change image data by a threshold voltage Vth compensation process of the driving transistor DT or a mobility a compensation process of the driving transistor DT to supply the changed image data to the data driver 130. Therefore, the data driver 130 converts the changed data into a data voltage Vdata by means of the digital-analog converter DAC to supply the converted data voltage to the corresponding sub pixel SP to perform the compensation process.

Further, the compensation unit 160 can also perform a compensation process for a sub pixel SP detected by the detection unit 170 in which a short circuit situation occurs. For example, the compensation unit 160 can perform a compensation process for reducing an output of a defective sub pixel in which a short occurs. Therefore, an output of the defective sub pixel can be reduced and the darkening of the defective sub pixel can be delayed (e.g., thus extending the life of the component), which will be described below with reference to FIGS. 3 to 4C.

The detection unit 170 detects a voltage difference between the first electrode and the second electrode of the sensing transistor SET to detect whether the light emitting element 150 is shorted. For example, the detection unit 170 can detect whether the anode and the cathode are shorted, by means of the voltage difference between the second node N2 and the fourth node N4, which will be described below with reference to FIGS. 3 to 4C.

The digital-analog converter DAC outputs a compensated data voltage Vdata output from the compensation unit 160 to the data line DL. Specifically, the digital-analog converter DAC converts the output digital compensation value into an analog data voltage Vdata to output the converted analog data voltage.

Hereinafter, a detection unit 170 which detects a defective sub pixel in which an anode and a cathode of a light emitting element 150 are shorted, in a display device 100 and a driving method of a display device according to an example embodiment of the present disclosure will be described in detail with reference to FIGS. 3 to 4C.

Figure 3:
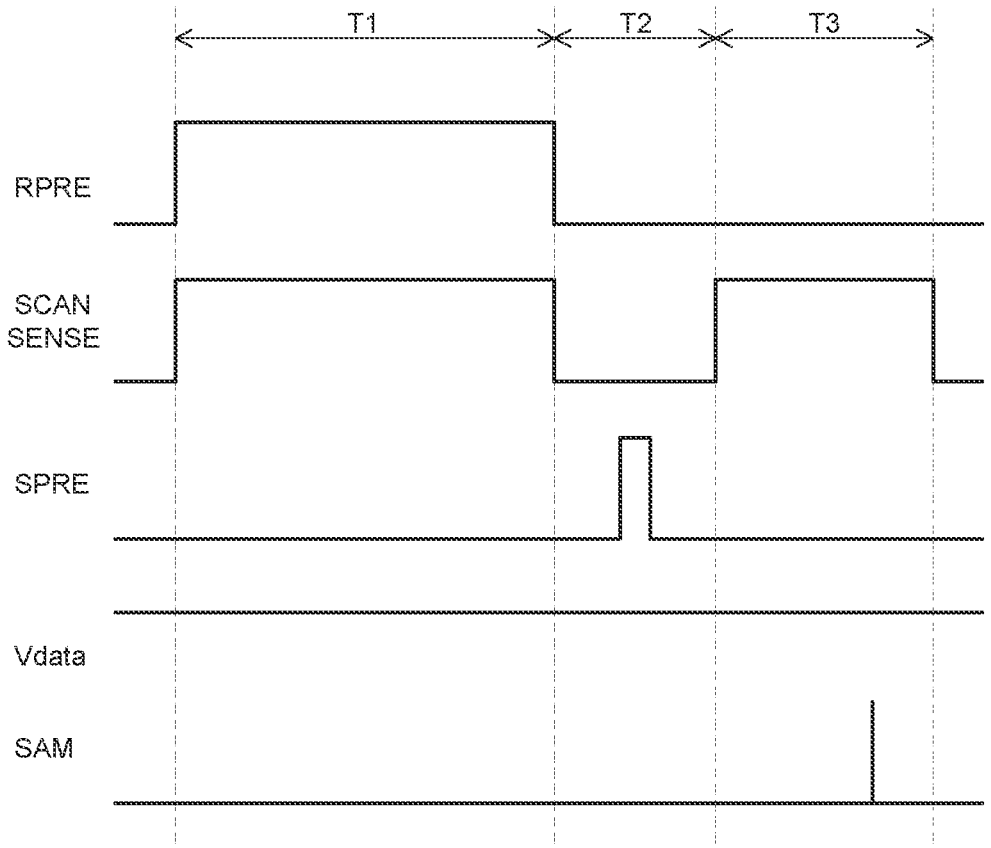
FIG. 3 is a waveform for explaining a display device and a driving method of a display device according to an example embodiment of the present disclosure.
Figure 4A:
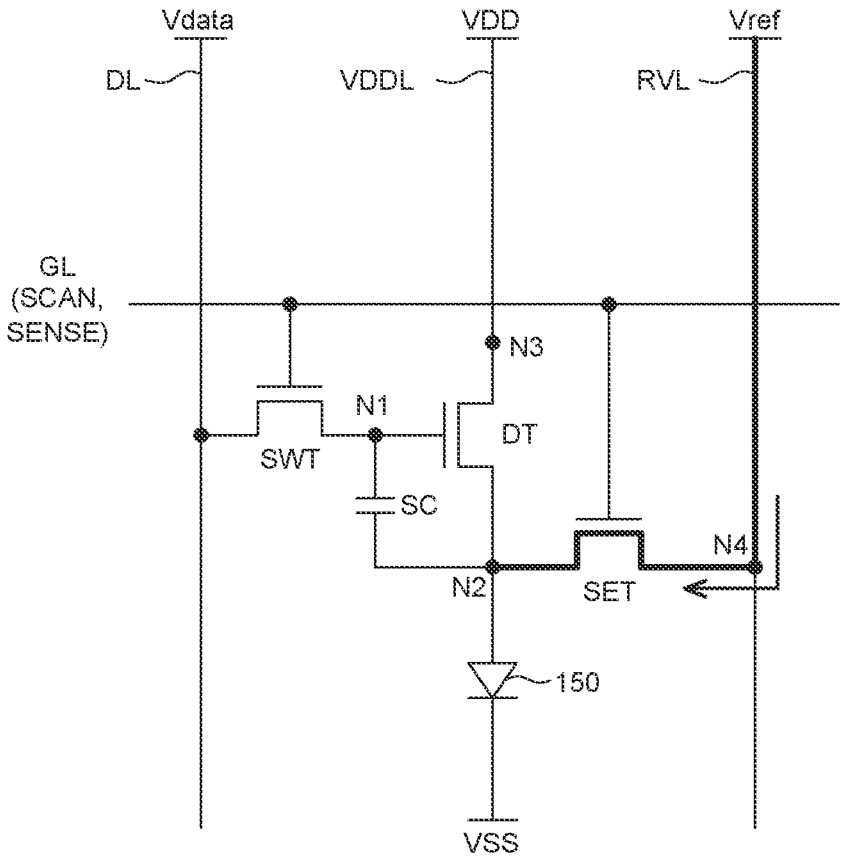
FIGS. 4A to 4C are circuit diagrams for explaining a process of detecting a normal sub pixel and a defective sub pixel in a display device and a driving method of a display device according to an example embodiment of the present disclosure.
Figure 4B:
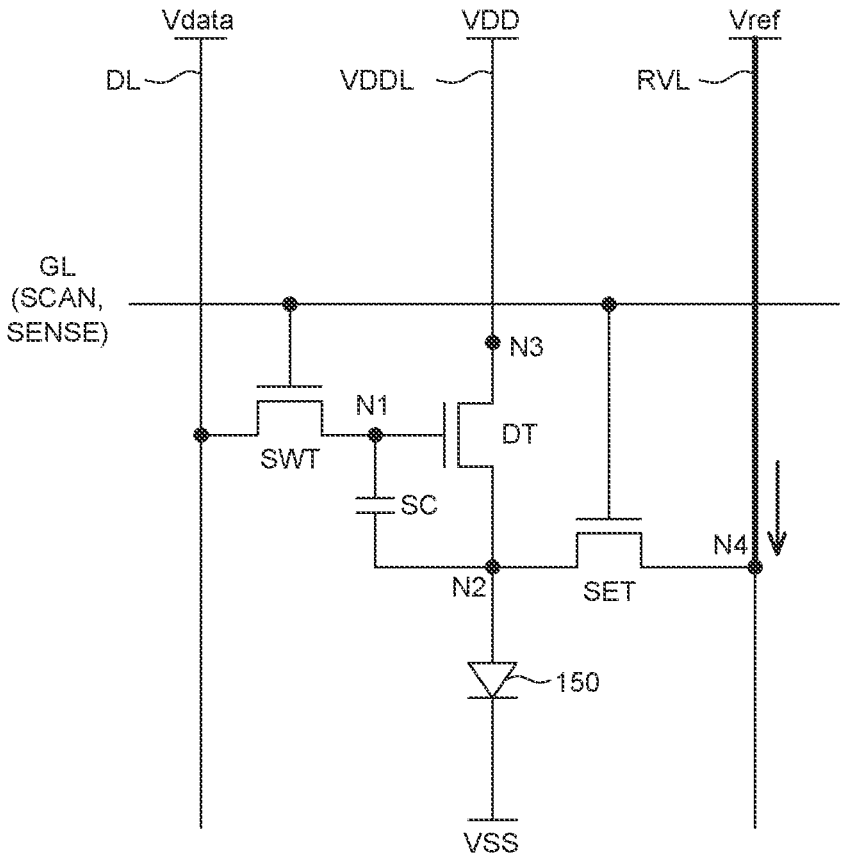

FIG. 3 is a waveform for explaining a display device and a driving method of a display device according to an example embodiment of the present disclosure. FIGS. 4A to 4C are circuit diagrams for explaining a process of detecting a normal sub pixel and a defective sub pixel in a display device and a driving method of a display device according to an example embodiment of the present disclosure.

Specifically, FIG. 3 illustrates a waveform for explaining a process for sensing a voltage difference between the second node N2 and the fourth node N4 of the sub pixel SP. FIG. 4A is a circuit diagram during a first time interval T1, FIG. 4B is a circuit diagram during a second time interval T2, and FIG. 4C is a circuit diagram for a third time interval T3. In FIGS. 4A to 4C, only a process of sensing a voltage difference between the second node N2 and the fourth node N4 by the sensing transistor SET is illustrated for the convenience of description.

First, referring to FIGS. 3 and 4A, during the first time interval T1, the driving initialization switch RPRE is turned on and the sensing initialization switch SPRE and the sampling switch SAM are turned off. Further, the gate driver 120 applies a gate high voltage which is a turn-on signal to the switching transistor SWT and the sensing transistor SET by means of the gate line GL.

For example, both the switching transistor SWT and the sensing transistor SET are turned on by the scan signal SCAN and the sensing signal SENSE. Further, the data voltage Vdata from the data driver 130 is supplied to the switching transistor SWT by means of the data line DL and the data voltage Vdata is applied to the gate electrode of the driving transistor DT by means of the turned-on switching transistor SWT. Specifically, as the driving initialization switch RPRE is turned on, the reference voltage Vref can be supplied to the reference voltage line RVL. At this time, the supplied reference voltage Vref can be a driving reference voltage VpreR. Accordingly, the driving reference voltage VpreR can be applied to the second node N2 by means of the turned-on sensing transistor SET.

Referring to FIGS. 3 and 4B, during the second time interval T2, the sensing initialization switch SPRE is turned on, and the driving initialization switch RPRE and the sampling switch SAM are both turned off. Further, the gate driver 120 applies a gate low voltage, which is a turn-off signal by means of the gate line GL, to turn off both the switching transistor SWT and the sensing transistor SET.

For example, as the sensing initialization switch SPRE is turned on, the reference voltage Vref (e.g., VpreS) can be supplied to the reference voltage line RVL. At this time, the supplied reference voltage Vref can be a sensing reference voltage VpreS. Specifically, since the sensing transistor SET is turned off, the sensing reference voltage VpreS supplied to the reference voltage line RVL can be applied to the fourth node N4. At this time, the source electrode of the driving transistor DT corresponding to the second node N2 is floated and the voltage of the second node N2 rises. The voltage of the second node N2 rises for a predetermined time and a rising amount is gradually reduced to be saturated.

Figure 4C:
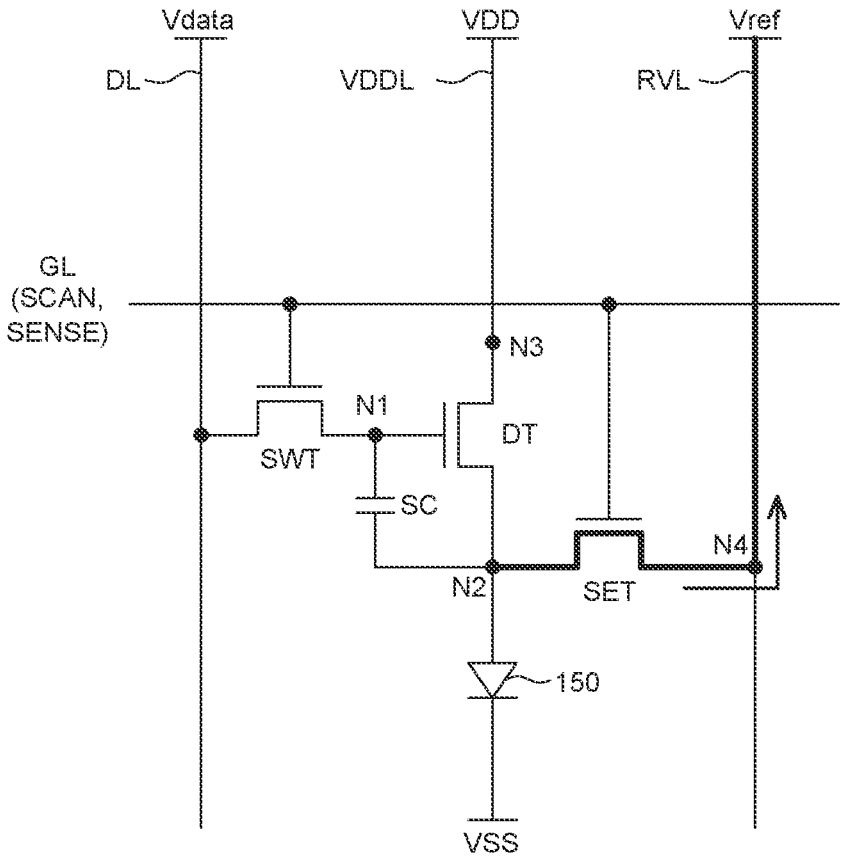

Referring to FIGS. 3 and 4C, during the third time interval T3, both the driving initialization switch RPRE and the sensing initialization switch SPRE are turned off. Further, the gate driver 120 applies the scan signal SCAN and the sensing signal SENSE by means of the gate line GL, and both the switching transistor SWT and the sensing transistor SET are turned on. Specifically, the sampling switch SAM is turned on at a timing when a predetermined time elapses from a timing when the voltage of the second node N2 starts to rise.

For example, the driving initialization switch RPRE and the sensing initialization switch SPRE block the reference voltage Vref from being applied to the sensing transistor SET. At this time, the sensing transistor SET is turned on so that the sensing transistor SET and the reference voltage line RVL can be electrically connected. Accordingly, the voltage difference between the second node N2 and the fourth node N4 can be stored in a capacitor Cst connected to the reference voltage line RVL. The sampling switch SAM is turned on to connect the reference voltage line RVL and the analog-digital converter ADC. Accordingly, the voltage stored in the capacitor Cst is supplied to the compensation unit 160 and the detection unit 170 by means of the sampling switch SAM and the analog-digital converter ADC. By doing this, the detection unit 170 can detect whether the light emitting element 150 is shorted.

Specifically, when the anode and the cathode of the light emitting element 150 are shorted, the voltage can be leaked through the light emitting element 150. For example, a voltage of the second node N2 connected to the anode can be leaked to the light emitting element 150. Accordingly, a sensed voltage of a defective sub pixel SP in which short occurs can be relatively lower than a voltage of a normal sub pixel SP in which short does not occur (e.g., due to the current leakage of a defective sub pixel). In other words, in the situation where the voltage difference between the second node N2 and the fourth node N4 is detected by the detection unit 170, the voltage difference of the defective sub pixel can be lower than the voltage difference of the normal sub pixel. Therefore, the detection unit 170 detects and compares the voltage difference between the second node N2 and the fourth node N4 of the plurality of sub pixels SP to detect a sub pixel SP in which short occurs (e.g., in this way, short circuited sub pixels can be identified). For example, when a voltage difference detected from a specific sub pixel SP is lower than a voltage difference detected from the other sub pixel SP by a predetermined range or more, the detection unit 170 can determine that the specific sub pixel is a defective sub pixel (e.g., has a short).

The detection unit 170 can detect a defective sub pixel and detect coordinates for the defective sub pixel. The detection unit 170 can provide the coordinates for the defective sub pixel to the compensation unit 160. The compensation unit 160 calculates a compensation value for the defective sub pixel to perform a compensation process on the defective sub pixel. At this time, the compensation unit 160 can calculate a compensation value for reducing an output of a defective sub pixel (e.g., in order to avoid exasperating the problem and making the short even worse leading to a dead sub pixel that is easily noticeable).

For example, the compensation process can be performed by adjusting an output gain of the sub pixel SP. Specifically, when the defective sub pixel is detected by the detection unit 170, the detection unit 170 can detect coordinates of the defective sub pixel. The detection unit 170 can map the detected coordinates and a surrounding area thereof. Information about the mapping area can be provided to the compensation unit 160. The compensation unit 160 can perform a compensation process of adjusting an output gain of the mapping area. Specifically, the compensation unit 160 can perform a compensation process for reducing an output gain of the mapping area. A changed gain value is supplied to the data driver 130 and the output gain of the mapping area can be reduced. Therefore, the plurality of sub pixels SP of the mapping area can emit light to be darker or less bright compared to the other sub pixels SP. For example, the output gain in the mapping area corresponding to the defective sub pixel and the surrounding area thereof is lowered to reduce a stress on the light emitting element 150 in which the short occurs. Accordingly, the darkening time of the defective sub pixel by the light emitting element 150 in which the short occurs is extended, in order to extend the lifespan of the display device 100.

Alternatively, the compensation process can be performed by adjusting the data voltage Vdata of the sub pixel SP. Specifically, the detection unit 170 can provide coordinates of the detected defective sub pixel to the compensation unit 160. The compensation unit 160 can perform the compensation process of adjusting the data voltage Vdata of the defective sub pixel. Specifically, the compensation unit 160 can perform a compensation process for reducing an output of a defective sub pixel. The changed data voltage Vdata value is supplied to the data driver 130 so that the output of the defective sub pixel can be reduced. Therefore, the defective sub pixel can emit light to be darker than the other sub pixel. For example, the output of the defective sub pixel is lowered so that the stress experienced by the light emitting element 150 in which short occurs can be reduced. Accordingly, the darkening time of the defective sub pixel by the light emitting element 150 in which short occurs is extended to extend the lifespan of the display device 100.

In addition, the darkening of the sub pixel according to the compensation process may not be actually visibly recognized by a user or may only be slightly recognized by the user. Therefore, even though the defective sub pixel emits light that is less bright, an overall display quality of the display device 100 may not be significantly affected. Accordingly, the degradation of the quality of the display device 100 can be minimized and the stress of the defective sub pixel can be reduced. For example, in this way, the embodied invention can better avoid a situation where a completely dead sub pixel is noticed by the user, by extending the life of a compromised sub pixel by reducing its load.

Generally, the normal sub pixel and the defective sub pixel can be detected before the shipment of the display device 100 and after the shipment of the display device 100.

Before the shipment of the display device 100, an external voltage is applied using source meter equipment, to detect whether there is a defective sub pixel. For example, before the shipment of the display device 100, a reference voltage Vref is applied by generating a voltage using separate equipment to detect a defective sub pixel. Further, a compensation value for the defective sub pixel is reflected to complete the compensation for the defective sub pixel at the time of the shipment of the display device 100.

However, the defective sub pixel can also be progressively generated even after the shipment of the display device 100. However, it is difficult to use separate equipment, such as a source meter, after the shipment. Therefore, after the shipment, a reference voltage Vref is applied using a power management IC PMIC connected to the display device 100 to detect the defective sub pixel. At this time, the detection of the defective sub pixel using PMIC can be performed when a separate sensing signal is applied to the detection unit 170.

In addition, after the shipment of the display device 100, the detection unit 170 can detect a defective sub pixel in an ON RF mode performed in a power on sequence, an RT mode performed in a vertical blank (VB) period between active periods AT of a display driving period, and an OFF RS mode performed in a power off sequence.

In the ON RF mode, when a power on signal is generated in the display device 100 to turn on the display device 100, the detection unit 170 can sense a voltage difference between the second node N2 and the fourth node N4 of each of the plurality of sub pixels SP. Further, the defective sub pixel in which the anode and the cathode of the light emitting element 150 are shorted can be detected based on the sensing result.

In the RT mode, the detection unit 170 can sense a voltage difference between the second node N2 and the fourth node N4 of each of the plurality of sub pixels SP during a display driving period in which the image is displayed. Specifically, the detection unit 170 can sense a voltage difference between the second node N2 and the fourth node N4 of each of the plurality of sub pixels SP during the vertical blank period at every frame period. Further, the defective sub pixel in which the anode and the cathode of the light emitting element 150 are shorted can be detected based on the sensing result.

In the OFF RS mode, when a power off signal is generated in the display device 100 to turn off the display device 100, the detection unit 170 can sense a voltage difference between the second node N2 and the fourth node N4 for each of the plurality of sub pixels SP. Further, the defective sub pixel in which the anode and the cathode of the light emitting element 150 are shorted can be detected based on the sensing result.

As described above, the display device 100 according to the example embodiment of the present disclosure can detect whether the light emitting element 150 of the sub pixel SP is shorted or compromised by means of the detection unit 170. Specifically, the detection unit 170 detects a voltage between the second node N2 and the fourth node N4 of the sensing transistor SET to detect whether the light emitting element 150 is shorted. At this time, the voltage of the second node N2 can be a driving reference voltage VpreR supplied by the driving initialization switch RPRE during the first time interval T1. Further, the voltage of the fourth node N4 can be a sensing reference voltage VpreS supplied by the sensing initialization switch SPRE during the second time interval T2.

For example, the display device 100 can apply different voltages to the second node N2 and the fourth node N4 during different time intervals using the driving initialization switch RPRE and the sensing initialization switch SPRE. At this time, the second node N2 can be a node connected to the light emitting element 150. Therefore, when the light emitting element 150 is shorted or short circuited, the voltage of the second node N2 can be leaked through the light emitting element 150. Accordingly, the voltage difference between the second node N2 and the fourth node N4 of the plurality of sub pixels SP is detected and compared to easily detect normal sub pixels and defective sub pixels.

Further, when the defective sub pixel is detected by the detection unit 170, the compensation unit 160 can calculate a compensation value for the defective sub pixel. Specifically, the compensation unit 160 can calculate a compensation signal for reducing an output of the defective sub pixel. Therefore, a stress applied to the defective sub pixel can be relieved and the darkening of the defective sub pixel can be delayed (e.g., the sub pixel can be controlled to operate at a reduced brightness, as such 50% or less, in order to extend its life). Accordingly, the lifespan of the display device 100 can be extended and dead sub pixels that are noticeable by a viewer can be avoided or at least delayed.

Moreover, the detection unit 170 can detect and compensate the defective sub pixel of the display device 100 not only before the shipment, but also after the shipment. For example, the output of the detected defective sub pixel is reduced to reduce the stress of the light emitting element 150 and delay the darkening.

The example embodiments of the present disclosure can also be described as follows:

According to an aspect of the present disclosure, a display device includes a display panel having a plurality of sub pixels including a switching transistor, a driving transistor, a sensing transistor, a storage capacitor, and a light emitting element, and a detection unit configured to sense a voltage difference between a first electrode and a second electrode of the sensing transistor to detect whether an anode and a cathode of the light emitting element are shorted. A gate electrode of the switching transistor and a gate electrode of the sensing transistor are connected to the same gate line.

The first electrode of the sensing transistor can be connected to the anode of the light emitting element.

The display device can further include a reference voltage line connected to the second electrode of the sensing transistor, a first initialization switch connected to the reference voltage line to apply a first reference voltage, a second initialization switch connected to the reference voltage line to apply a second reference voltage, and a sampling switch connected to the reference voltage line to transmit a voltage from the sensing transistor to the detection unit.

The detection unit can detect whether the light emitting element is shorted, by means of a first time interval in which the sensing transistor is turned on, and the first reference voltage is applied to the first electrode of the sensing transistor through the first initialization switch, a second time interval in which the sensing transistor is turned off, and the second reference voltage is applied to the second electrode of the sensing transistor through the second initialization switch, and a third time interval in which the sensing transistor is turned on, and the voltage difference between the first electrode and the second electrode of the sensing transistor is transmitted to the detection unit through the sampling switch.

In the first time interval, the second initialization switch and the sampling switch can be turned off, in the second time interval, the first initialization switch and the sampling switch can be turned off, and in the third time interval, the first initialization switch and the second initialization switch can be turned off.

The first reference voltage and the second reference voltage can have different values.

When a voltage difference detected from any one sub pixel among the plurality of sub pixels is lower than a voltage difference detected from a plurality of another sub pixels by a predetermined range or more, the detection unit can be configured to detect that short occurs in the any one sub pixel.

The display device can further include a compensation unit connected to the detection unit. The compensation unit can calculate a compensation signal which reduces an output of a sub pixel which is detected by the detection unit that short occurs.

The display device can further include a data driver which supplies a data voltage to the plurality of sub pixels, a gate driver which supplies a gate signal to the plurality of sub pixels, and a timing controller which controls the data driver and the gate driver. The timing controller can include the detection unit.

According to another aspect of the present disclosure, a driving method of a display device includes: turning on a sensing transistor of each of the plurality of sub pixels, and applying a first reference voltage to a first electrode of the sensing transistor through a first initialization switch, turning off the sensing transistor, and applying a second reference voltage to a second electrode of the sensing transistor through a second initialization switch, turning on the sensing transistor, and transmitting a voltage difference between the first electrode and the second electrode of the sensing transistor to the detection unit through a sampling switch, and detecting whether an anode and a cathode of the light emitting element in the plurality of sub pixels are shorted by comparing the voltage difference of the plurality of sub pixels, through the detection unit.

In the applying of the first reference voltage, the second initialization switch and the sampling switch can be turned off, in the applying of the second reference voltage, the first initialization switch and the sampling switch can be turned off, and in the transmitting of the voltage difference to the detection unit, the first initialization switch and the second initialization switch can be turned off.

In the detecting whether of the short occurs, when a voltage difference detected from any one sub pixel among the plurality of sub pixels is lower than a voltage difference detected from a plurality of another sub pixels by a predetermined range or more, the detection unit can be detected that short occurs in the any one sub pixel.

The driving method of the display device can further include: after the detecting of whether the short occurs, calculating a compensation signal which reduces an output of a sub pixel in which the short occurs detected by the detection unit, through a compensation unit.

The plurality of sub pixels can further include a switching transistor, a driving transistor, and a storage capacitor. A gate electrode of the switching transistor and a gate electrode of the sensing transistor can be connected to the same gate line.

The first electrode of the sensing transistor can be connected to the anode of the light emitting element.

The driving method of the display device can further include a reference voltage line connected to the second electrode of the sensing transistor. The first initialization switch, the second initialization switch, and the sampling switch can be connected to the reference voltage line.

The first reference voltage and the second reference voltage can have different values.

The driving method of the display device can further include: a data driver which supplies a data voltage to the plurality of sub pixels, a gate driver which supplies a gate signal to the plurality of sub pixels, and a timing controller which controls the data driver and the gate driver. The timing controller can include the detection unit.

Although the example embodiments of the present disclosure have been described in detail with reference to the accompanying drawings, the present disclosure is not limited thereto and can be embodied in many different forms without departing from the technical concept of the present disclosure. Therefore, the example embodiments of the present disclosure are provided for illustrative purposes only but not intended to limit the technical concept of the present disclosure. The scope of the technical concept of the present disclosure is not limited thereto.

Therefore, it should be understood that the above-described example embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display device, comprising:

a display panel having a plurality of sub pixels, each of the sub pixels including a switching transistor, a driving transistor, a sensing transistor, a storage capacitor, and a light emitting element; and a detector configured to sense a voltage difference between a first electrode of the sensing transistor and a second electrode of the sensing transistor for determining that an anode and a cathode of the light emitting element are shorted, wherein a gate electrode of the switching transistor and a gate electrode of the sensing transistor are connected to a same gate line, and wherein the detector is further configured to determine that the anode and the cathode of the light emitting element are short circuited when the voltage difference is lower than a reference voltage difference.

2. The display device according to claim 1, wherein the first electrode of the sensing transistor is connected to the anode of the light emitting element.

3. The display device according to claim 1, further comprising:

a reference voltage line connected to the second electrode of the sensing transistor;

a first initialization switch connected to the reference voltage line to apply a first reference voltage to the reference voltage line;

a second initialization switch connected to the reference voltage line to apply a second reference voltage to the reference voltage line; and a sampling switch connected to the reference voltage line and configured to transmit a voltage from the sensing transistor to the detector.

4. The display device according to claim 3, wherein the first electrode of the sensing transistor is configured to receive the first reference voltage through the first initialization switch during a first time interval when the sensing transistor is turned on, wherein the second electrode of the sensing transistor is configured to receive the second reference voltage through the second initialization switch during a second time interval when the sensing transistor is turned off, and wherein the detector is further configured to receive the voltage difference between the first electrode and the second electrode of the sensing transistor through the sampling switch during a third time interval when the sensing transistor is turned on.

5. The display device according to claim 4, wherein in the first time interval, the second initialization switch and the sampling switch are turned off, wherein in the second time interval, the first initialization switch and the sampling switch are turned off, and wherein in the third time interval, the first initialization switch and the second initialization switch are turned off.

6. The display device according to claim 4, wherein the first reference voltage and the second reference voltage have different values.

7. The display device according to claim 1, wherein the detector is further configured to detect a short in any one sub pixel among the plurality of sub pixels when a voltage difference detected from the any one sub pixel is lower than a voltage difference detected from one or more other sub pixels among the plurality of sub pixels by a predetermined range or more.

8. The display device according to claim 1, further comprising:

a compensator connected to the detector, wherein the compensator is configured to generate a compensation signal that reduces an output of a sub pixel detected by the detector as having a short.

9. The display device according to claim 1, further comprising:

a data driver configured to supply a data voltage to the plurality of sub pixels;

a gate driver configured to supply a gate signal to the plurality of sub pixels; and a timing controller configured to control the data driver and the gate driver, wherein the timing controller includes the detector.

10. A method of controlling a display device, the method comprising:

turning on a sensing transistor of one or more of a plurality of sub pixels, and applying a first reference voltage to a first electrode of the sensing transistor through a first initialization switch;

turning off the sensing transistor, and applying a second reference voltage to a second electrode of the sensing transistor through a second initialization switch;

turning on the sensing transistor, and transmitting a voltage difference between the first electrode and the second electrode of the sensing transistor to a detector through a sampling switch;

detecting a short between an anode of a light emitting element and a cathode of the light emitting element among the plurality of sub pixels based on comparing the voltage difference with a reference voltage difference;

in response to detecting the short, generating, by a compensator, a compensation signal to reduce an output of a sub pixel having the short; and supplying the compensation signal to the sub pixel having the short.

11. The method according to claim 10, wherein the first reference voltage is applied to the first electrode of the sensing transistor while the second initialization switch and the sampling switch are turned off, wherein the second reference voltage is applied to the second electrode of the sensing transistor while the first initialization switch and the sampling switch are turned off, and wherein the first initialization switch and the second initialization switch are turned off while the voltage difference is transmitted to the detector.

12. The method according to claim 10, wherein the detector detects a short when a voltage difference detected from any one sub pixel among the plurality of sub pixels is lower than a voltage difference detected from one or more other sub pixels among the plurality of sub pixels by a predetermined range or more.

13. The method according to claim 10, wherein each of the plurality of sub pixels includes a switching transistor, a driving transistor, and a storage capacitor, and wherein a gate electrode of the switching transistor and a gate electrode of the sensing transistor are connected to a same gate line.

14. The method according to claim 10, wherein the first electrode of the sensing transistor is connected to the anode of the light emitting element.

15. The method according to claim 10, further comprising:

a reference voltage line connected to the second electrode of the sensing transistor, wherein the first initialization switch, the second initialization switch, and the sampling switch are connected to the reference voltage line.

16. The method according to claim 10, wherein the first reference voltage and the second reference voltage have different values.

17. The method according to claim 10, further comprising:

supplying, via a data driver, a data voltage to the plurality of sub pixels;

supplying, via a gate driver, a gate signal to the plurality of sub pixels; and controlling, via a timing controller, the data driver and the gate driver, wherein the timing controller includes the detector.

18. A method for controlling a display device, the method comprising:

supplying, via a voltage reference line, a first reference voltage to a first electrode of a sensing transistor of a sub pixel among a plurality of sub pixels in a display panel of the display device;

supplying, via the voltage reference line, a second reference voltage to a second electrode of the sensing transistor;

determining a voltage difference between the first electrode and the second electrode of the sensing transistor; and in response to the voltage difference being less than a reference voltage difference, determining that a short circuit situation exists between an anode and a cathode of a light emitting element in the sub pixel.

19. The display device according to claim 1, further comprising:

a reference voltage line connected to the second electrode of the sensing transistor;

a sampling capacitor connected to the reference voltage line;

a driving initialization switch connected to the sampling capacitor and configured to supply a first reference voltage to the first electrode of the sensing transistor; and a sensing initialization switch connected to the sampling capacitor and configured to supply a second reference voltage to the first electrode of the sensing transistor, wherein the first reference voltage is different than the second reference voltage.

* * * * *